US007418794B2

(12) United States Patent
Kittrell, III

(10) Patent No.: US 7,418,794 B2
(45) Date of Patent: Sep. 2, 2008

(54) THREE-DIMENSIONAL DISPLAY FRAME ASSEMBLY

(76) Inventor: Irvin A. Kittrell, III, 573 W. Market St., York, PA (US) 17404

( * ) Notice: Subject to any disclaimer, the term of this patent is extended or adjusted under 35 U.S.C. 154(b) by 142 days.

(21) Appl. No.: 11/247,897

(22) Filed: Oct. 11, 2005

(65) Prior Publication Data

US 2006/0080878 A1 Apr. 20, 2006

Related U.S. Application Data

(60) Provisional application No. 60/618,652, filed on Oct. 14, 2004, provisional application No. 60/622,438, filed on Oct. 27, 2004, provisional application No. 60/655,658, filed on Feb. 23, 2005.

(51) Int. Cl.
*G09F 1/00* (2006.01)

(52) U.S. Cl. ..... 40/124.16; 40/124.14; 40/124.08; 40/752; 40/124.06; 40/775; 40/539; 40/800; 40/219; 40/777

(58) Field of Classification Search ..... 40/124.06, 40/124.08, 124.14, 124.16, 219, 539, 752, 40/777, 900, 800; 229/92.8
See application file for complete search history.

(56) References Cited

U.S. PATENT DOCUMENTS

| | | | | | |
|---|---|---|---|---|---|
| 22,109 | A | * | 11/1858 | Hayes | 237/48 |
| 1,516,159 | A | * | 11/1924 | Southworth et al. | 40/539 |
| 1,648,654 | A | * | 11/1927 | Meller | 40/124.16 |
| 2,187,721 | A | * | 1/1940 | Wolfson | 40/539 |
| 3,897,645 | A | * | 8/1975 | Scheyer | 40/800 |
| 4,001,958 | A | * | 1/1977 | Fecko | 40/124.06 |
| 4,130,197 | A | * | 12/1978 | Fox | 206/45.26 |
| 5,450,680 | A | * | 9/1995 | Bromberg | 40/124.08 |
| 5,758,438 | A | * | 6/1998 | Crowell | 40/124.08 |
| 5,787,618 | A | * | 8/1998 | Mullis | 40/219 |
| 6,386,370 | B1 | * | 5/2002 | Wigton et al. | 206/763 |
| 6,536,145 | B2 | * | 3/2003 | Burtch et al. | 40/124.08 |

* cited by examiner

*Primary Examiner*—Lesley D. Morris
*Assistant Examiner*—Shin Kim
(74) *Attorney, Agent, or Firm*—Hooker & Habib, P.C.

(57) ABSTRACT

A three-dimensional display frame assembly for displaying planar display material in respective multiple planes. The frame assembly can be provided as a single-sheet preform and can be self-standing.

17 Claims, 12 Drawing Sheets

Fig. 7
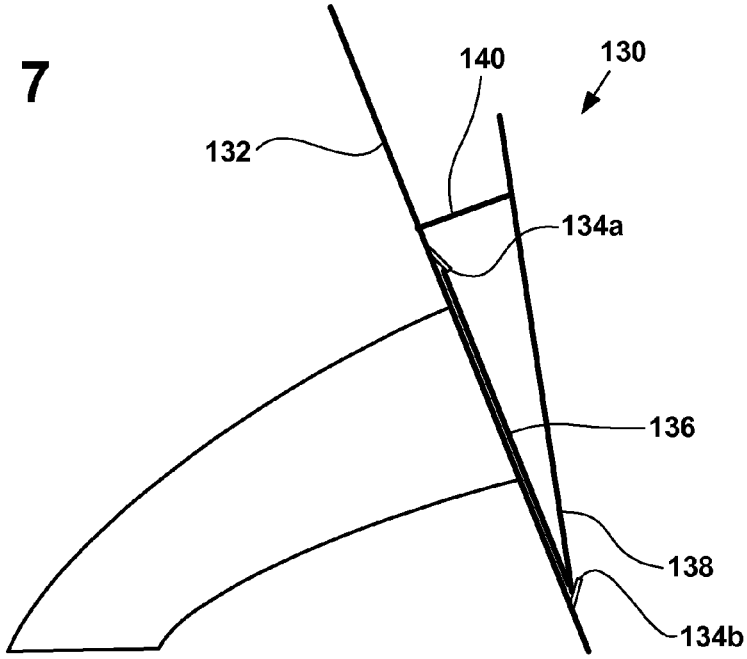
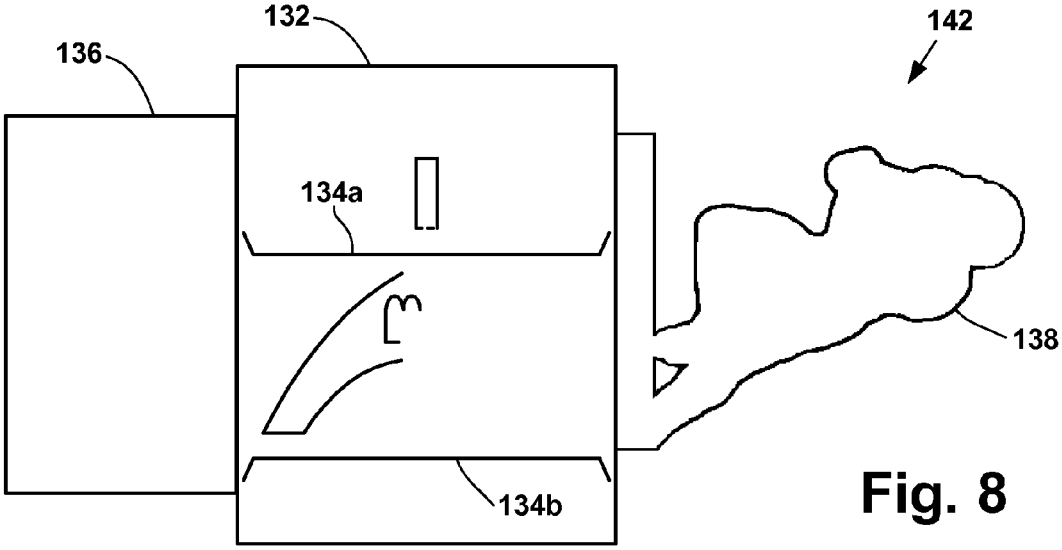
Fig. 8

Fig. 9
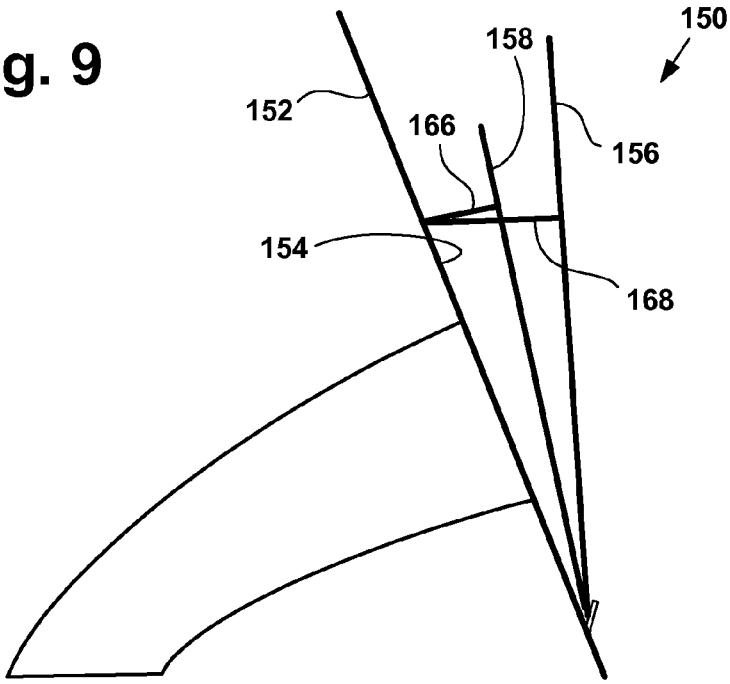
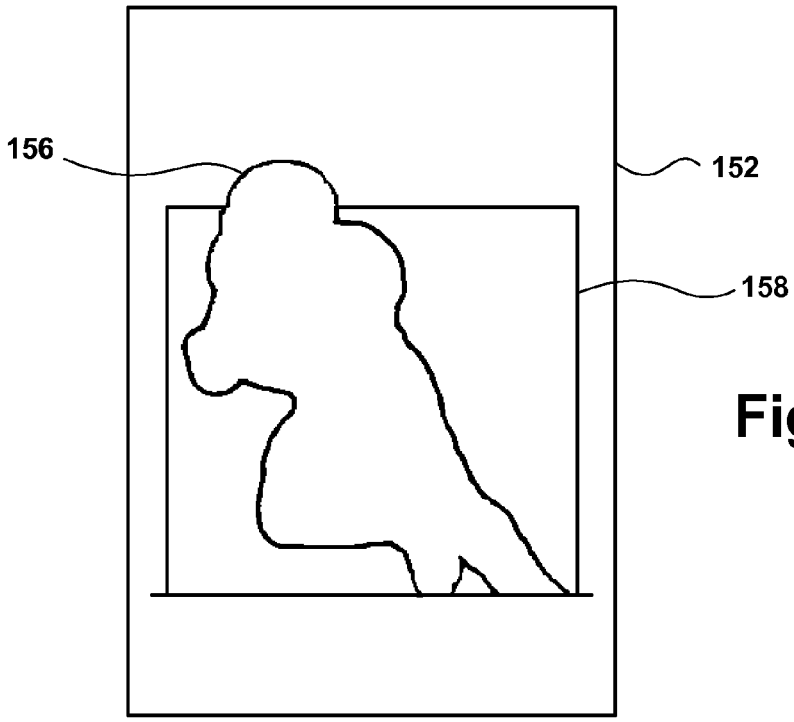
Fig. 10

Fig. 18
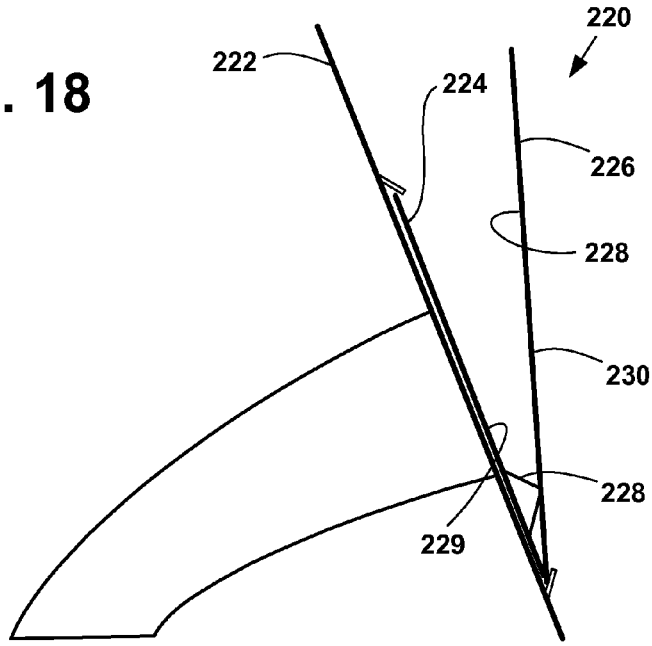
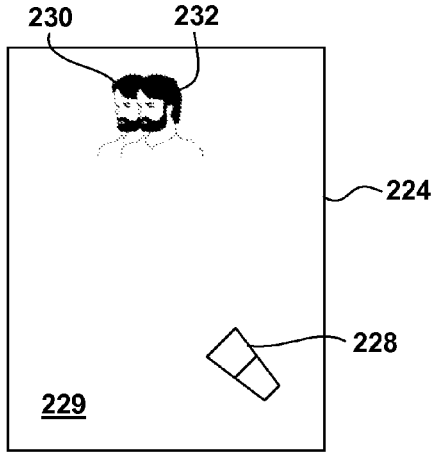
Fig. 19
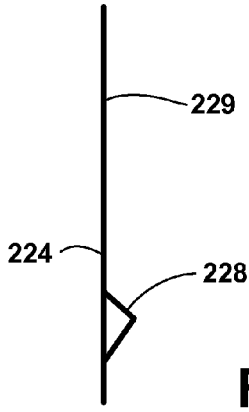
Fig. 20

Fig. 21
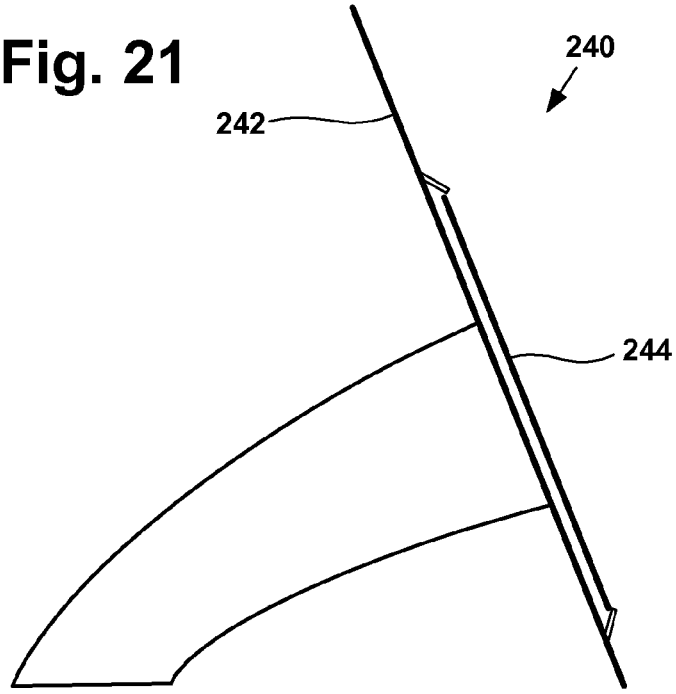
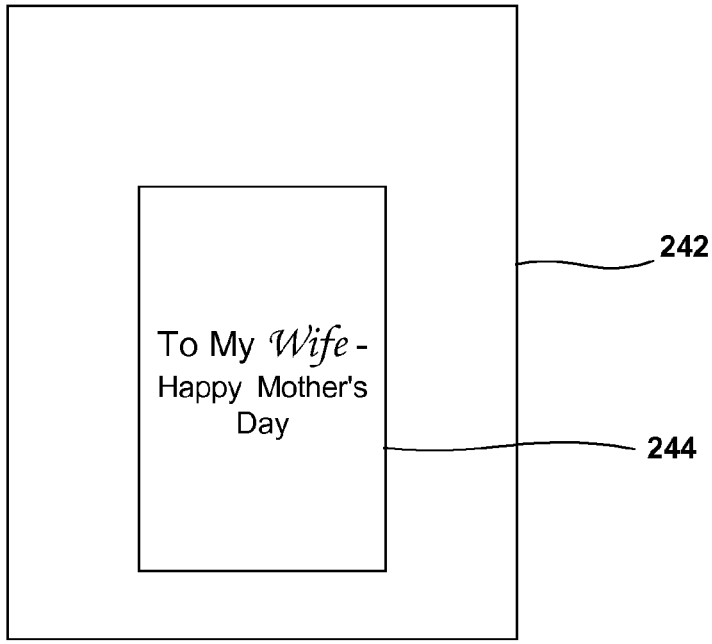
Fig. 22

THREE-DIMENSIONAL DISPLAY FRAME ASSEMBLY

This application claims the benefit of U.S. Provisional Application No. 60/618,652 filed Oct. 14, 2004, U.S. Provisional Application No. 60/622,438 filed Oct. 27, 2004, and U.S. Provisional Application No. 60/655,658 filed Feb. 23, 2005.

FIELD OF THE INVENTION

The invention relates to a display frame for displaying a photograph, baseball card, ticket, or similar planar display material.

DESCRIPTION OF THE PRIOR ART

Display frames for displaying photographs or similar display material are popular and well known items. Conventional free-standing display frames formed from folded flat paper sheet stock are known.

These known display frames, however, do not make practical advertising or promotional items. Manufacturing costs involved in some frames are high, and so the display frames are relatively expensive. Folded frames are difficult to store and distribute. Frames having a substrate are relatively thick and heavy, and mounting components are often lost.

To improve on these known display frames, I developed a single-sheet display frame disclosed in my pending U.S. patent application Ser. No. 10/807,619 filed Mar. 24, 2004 (which application is incorporated by reference as if fully set forth herein).

The single-sheet display frame can be distributed as an inexpensive and cost-effective advertising or promotional item. Spaced die-cut slots are arranged to receive respective portions of the display material for holding the display material in the frame between the slots. An easel is also die-cut into the sheet and is foldable along a fold for supporting the frame in a self-standing, generally upright position.

The frame can be stored and distributed as a flat paper sheet with the easel unopened. A large number of frames can be easily and compactly stored as flat sheets.

Although the single-sheet display frame has a number of advantages, the frame and the display material essentially lie in a common plane and so in effect form a two-dimensional display in use. It would be desirable to have the display frame used in providing a three-dimensional display for greater visual impact.

SUMMARY OF THE INVENTION

The present invention is a three-dimensional display assembly that can incorporate the single-sheet display frame. The component parts of the assembly, including the display frame, can be conveniently provided and distributed as a flat-sheet to later form the three-dimensional assembly.

A three-dimensional display assembly in accordance with the present invention includes a frame formed from a single, integral flat sheet. The sheet is preferably paperboard sheet stock but other suitable materials, such as plastic, can be used. The sheet includes a first display material and a first slot die-cut in the frame. The slot is arranged to receive one end portion of a second display material for holding the second display material in the frame. A first standoff member extends between the first and second display materials to space the other end of the second display material away from the first display material.

The standoff-member may be die-cut into the frame sheet and foldable along a fold line to abut the second display material. The void created by folding out the standoff member is covered by the second display material.

The single-sheet display frame disclosed in my '619 application can be incorporated into other embodiments of the invention in which the first display material is not integrally formed with the frame. For example, a photograph can be used as the first display material. The display frame includes a second slot and the slots cooperatively hold the first display material in the frame.

In yet other embodiments of the present invention an end portion of a third display material is held in the slot and a second standoff member spaces the other end of the third display material away from the second display material. The standoff members can also be formed by folding a portion of one or both of the display members, and additional display materials can be held in the slot if desired.

A particularly advantageous variation of the above embodiment adds a visually-appealing "holographic effect" to the three-dimensional display. An interior display surface or portions of the surface is formed from foil or reflective material that reflects printing on a facing display surface. The reflection is visible to a viewer to generate the holographic effect.

Another advantageous embodiment incorporates the single-sheet frame in which the first display material is a card printed with text or verse. The display assembly when assembled forms a greeting card. The card containing the text or verse is preferably removable and can be replaced by another card having different text or verse to effectively form a new greeting card. A photograph or other additional display material can be held in the frame beneath the card. The photograph is revealed when changing cards or is displayed in the frame after the card is discarded.

Three-dimensional display assemblies of the present invention have a number of advantages. The assemblies are inexpensive to manufacture and are readily customizable for specific sponsors, target audiences, or recipients. The frames can be conveniently stored, stacked, mailed, and distributed as flat sheets without the need for folding. No glues or adhesives are required.

Other objects and features of the invention will become apparent as the description proceeds, especially when taken in conjunction with the accompanying twelve drawing sheets illustrating ten embodiments of the invention.

BRIEF DESCRIPTION OF THE DRAWINGS

FIG. 7 is a side view of a third embodiment three-dimensional display frame assembly;

FIG. 8 is a view of the frame, first display material, and second display material being provided as a single sheet prior to being assembled to form the three-dimensional display assembly shown in FIG. 7;

FIG. 9 is a side view of a fourth embodiment three-dimensional display frame assembly;

FIG. 10 is a front view of the three-dimensional display frame assembly shown in FIG. 9;

FIG. 18 is a side view of an eighth embodiment three-dimensional display frame assembly;

FIG. 19 is a front view of the second display material of the three-dimensional display frame assembly shown in FIG. 18 being provided as a flat sheet prior to assembly;

FIG. 20 is a side view of the second display material shown in FIG. 19 after being folded and prior to assembly;

FIG. 21 is a side view of a ninth embodiment three-dimensional display frame assembly, the assembly partially assembled;

FIG. 22 is a front view of the partial display frame assembly shown in FIG. 21;

DESCRIPTION OF THE PREFERRED EMBODIMENTS

Figure 1:
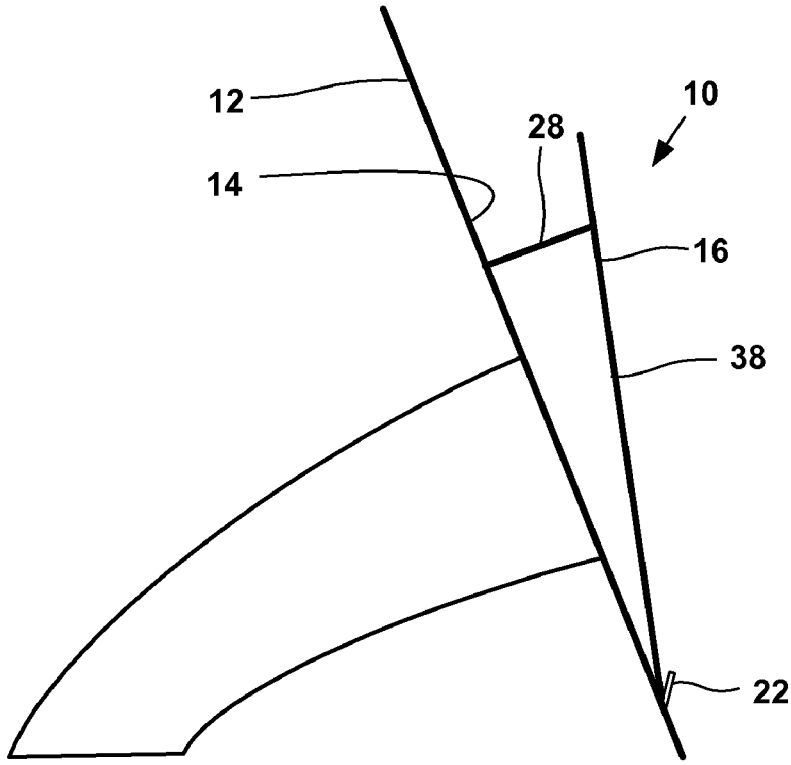
FIG. 1 is a side view of a first embodiment three-dimensional display assembly in accordance with the present invention.
Figure 2:
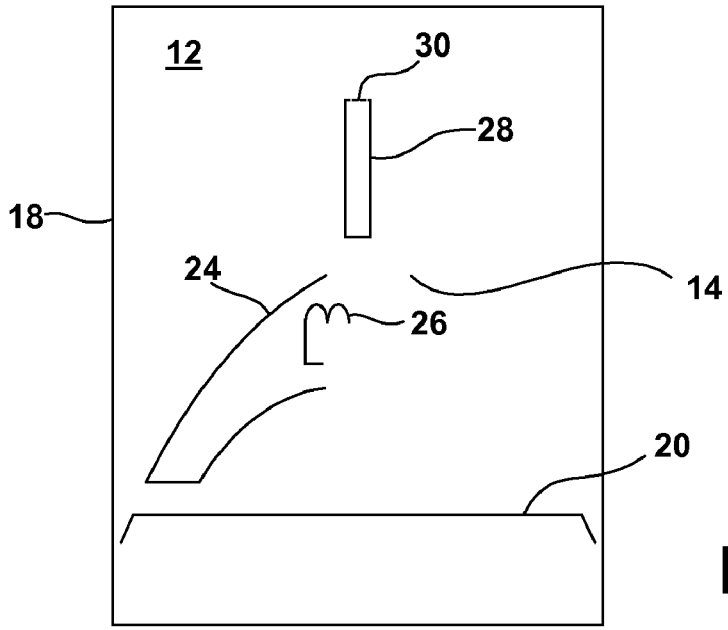
FIG. 2 is a front view of the display frame of the three-dimensional display assembly shown in FIG. 1 prior to being unfolded to form a part of the assembly.
Figure 3:
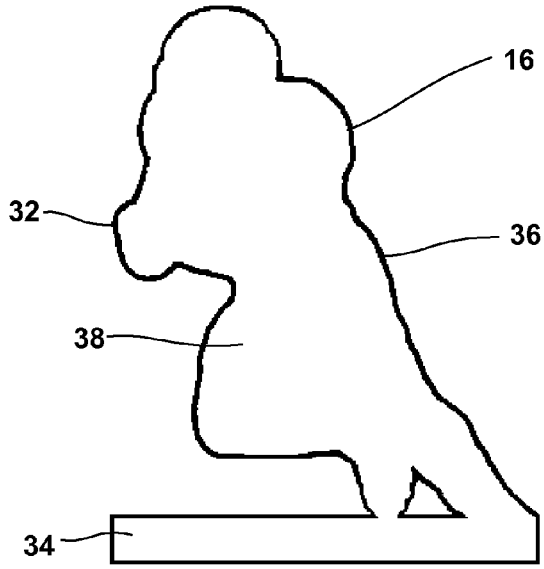
FIG. 3 is a front view of the second display material.

FIGS. 1-3 illustrate a first embodiment three-dimensional display frame assembly 10 in accordance with the present invention. Frame assembly 10 includes a display frame 12 that displays for viewing a first planar display material 14 and a second planar display material 16. The second display material 16 is positioned over and spaced away from the first display material 14 to form a three-dimensional display.

Display frame 12 is formed from flat integral paperboard sheet stock 18. For clarity sheet blank 18 is shown without printing on the sheet. Typical embodiments of sheet blank 18 would included printing (text, graphics, or a combination of text and graphics) as part of the frame's visual design. Sheet blank 18 can also be laminated on the front or rear faces after printing in a conventional manner.

Display frame 12 includes a lower slit or slot 20 that receives the second display material 16. The slot 20 includes an elongate straight portion and angled end portions that cooperate to define a flap 22. The configuration of slot 20 can vary in other embodiments to best receive and support the intended display material.

An easel 24 is die-cut in frame 12 to enable the frame to be free-standing. Easel 24 is above slot 20 and is foldable away from the remainder of the frame. A die-cut, foldable support tab 26 engages the easel and resists collapse of the easel. Easel 24 and support tab 26 can be eliminated if a free-standing frame is unnecessary.

First display material 14 is integrally formed with frame 12. In the illustrated embodiment easel 24 and support tab 26 are located in the display material 14. Elongate support or standoff member 28 is die-cut in display material 14 and is foldable along fold line 30 to extend away from the frame 12. First display material 14 typically includes printing (not shown) that cooperates with the frame and second display material 16 to provide a visually pleasing display.

Second display material 16 is cut from paperboard sheet stock 32 and includes a base or end portion 34 and a body portion 36. The base 34 is configured to be received in frame slot 20. Body portion 36 is cut in the desired silhouette, and has a front display side 38 that has desired printing for display. The illustrated embodiment has, as a non-limiting example, body portion 36 printed with a photograph of a (U.S.) football player and cut in the silhouette of the player.

To assemble the display assembly 10, easel 24 and support tab 26 are folded outwardly and the base of the second display material 16 is inserted into frame slot 20. Standoff member 28 is folded outwardly to support the body portion 36 away from the first display material 14 as shown in FIG. 1.

Figure 4:
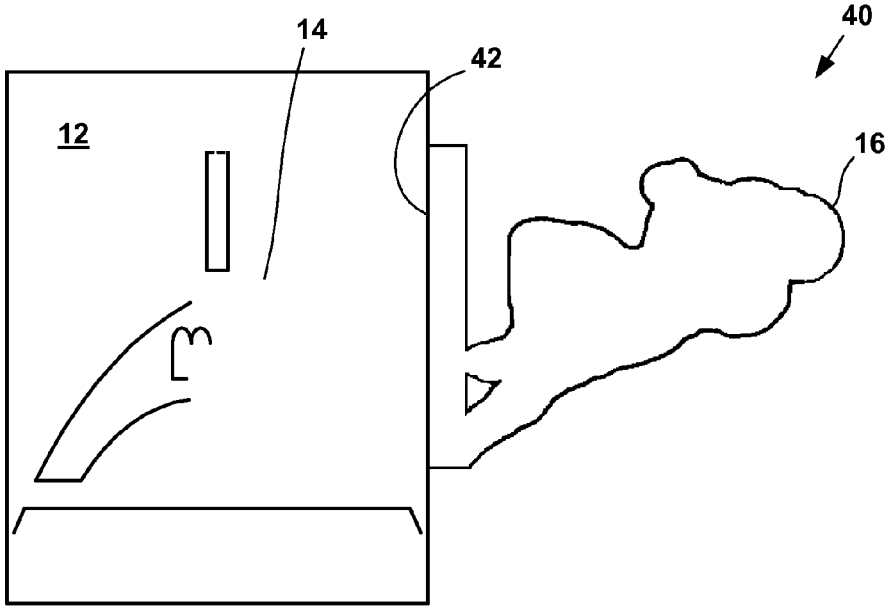
FIG. 4 is a view of the frame and second display material being provided as a single sheet prior to being assembled to form the three-dimensional display assembly.

Display assembly 10 is intended to be a low-cost advertising or promotional item. Display assembly 10 is preferably distributed unassembled as a flat sheet or preform 40 that include frame 12 and display materials 14 and 16 as integral portions of the preform 40. See FIG. 4. Second display material 16 is removably joined to frame 12 by intermittent die-cut line 42.

Figure 5:
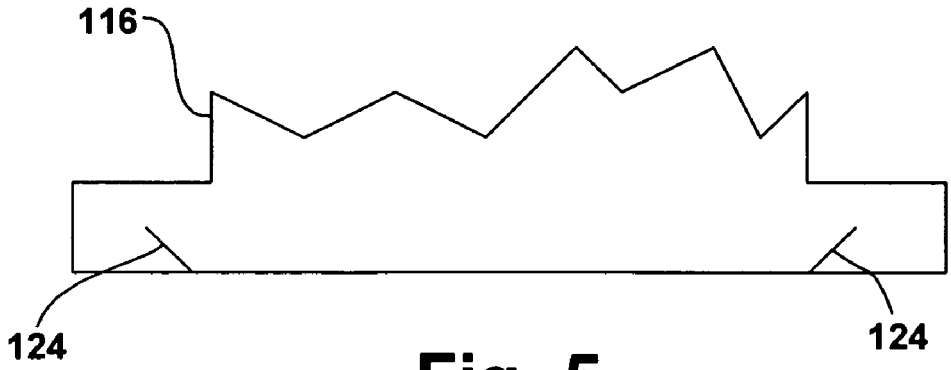
FIG. 5 is a front view of the second display material of a second embodiment three-dimensional display assembly.
Figure 6:
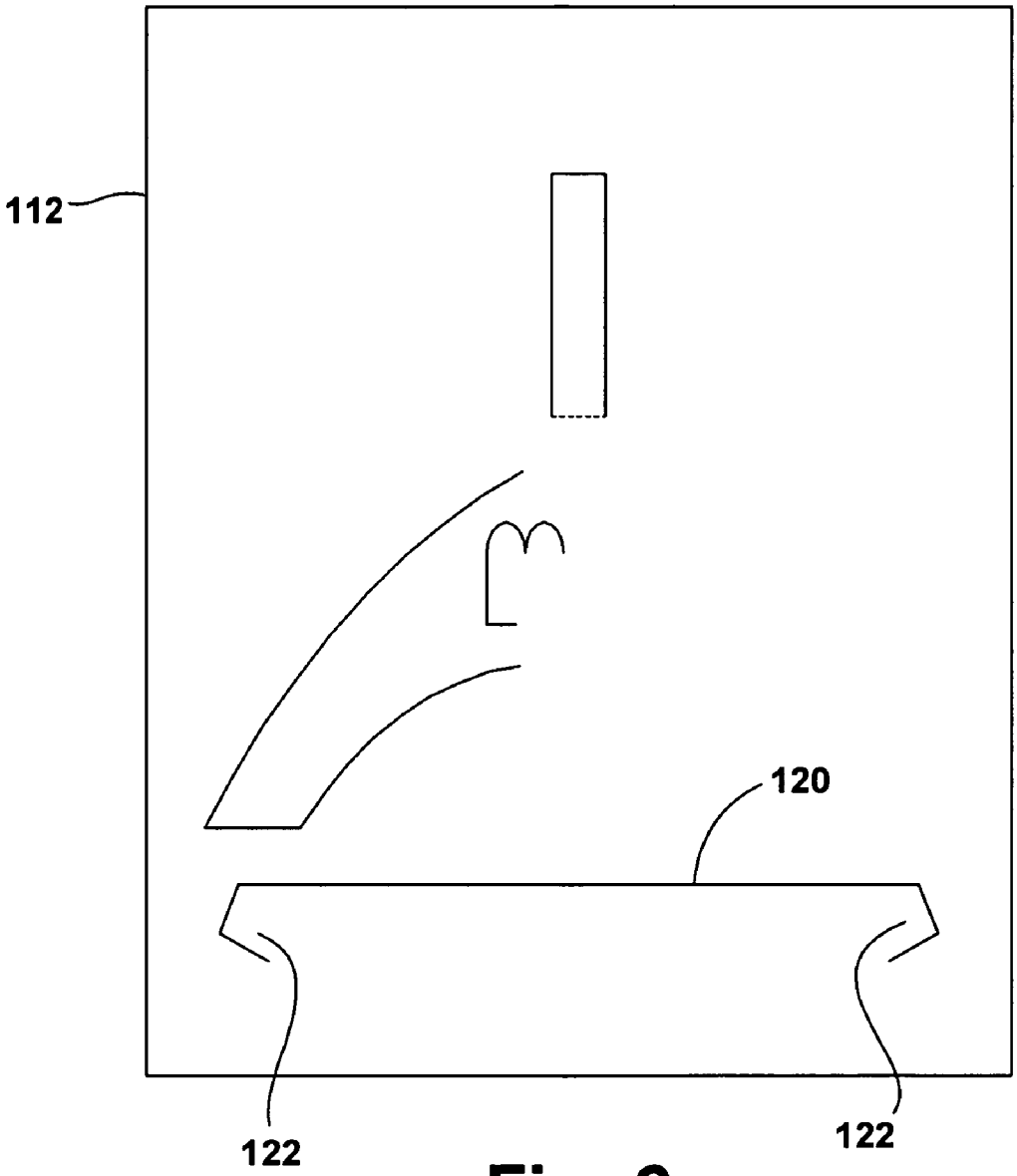
FIG. 6 is a front view of the display frame of the second embodiment three-dimensional display assembly.

FIGS. 5 and 6 illustrate the frame 112 and second display material 116 of a second embodiment three-dimensional display frame assembly. Frame 112 is otherwise identical to frame 12 but the angled ends of slot 120 define elongate tabs 122 at opposite ends of the slot. Second display material 116 is otherwise identical to second display material 16 but includes spaced apart slots 124 formed in the base. Slots 124 are spaced apart slightly less than the overall width of slot 120. Tabs 122 are inserted into slots 124 during assembly to resist movement of the base out of the frame slot and help retain display material 116 in frame 112.

A potential problem with display frame assembly 10 is that the second display material 16 may not completely overly or cover the frame or the first display material 14. The hole or void left in the frame/first display material by unfolding the easel 24 and support tab 26 may be visible when viewing the front of the assembly. FIG. 7 illustrates a third embodiment three-dimensional display frame assembly 130 that overcomes this potential problem.

Display frame assembly 130 includes a single-sheet display frame 132 as disclosed in my pending U.S. patent application Ser. No. 10/807,619. Frame 132 includes opposed upper and lower slots **134*a*, 134*b* that retain separate and removable first display material 136. The display material 136 overlies the easel and support tab portions of the frame 132** and covers the void created in the frame when the easel is unfolded.

Second display material 138 is retained in the lower slot **134*b*; tab and slot retention features can be included as previously described to help retain display material 138 in the slot. Standoff member 140 is die-cut in frame 132 above the upper slot 134***a* and folds out to space the second display material away from the frame as shown. Alternatively, standoff member 140 can be formed in the first display material 136.

FIG. 8 illustrates display frame assembly 130 being distributed unassembled as a flat sheet or preform 142. Preform 142 is similar to preform 40 but includes the second slot 134*a* and first display material 136 removably joined to frame 132.

Use of the single-sheet display frame 132 with removable first display material 136 enables a user to have his or her own photographs or other art work form the first display material and be part of the three-dimensional display frame assembly. The user can select or replace the work as desired. If the assembly is intended for displaying material provided by the user, a preform similar to preform 142 but without the first display material 136 is provided.

The embodiments shown in FIGS. 1-8 include first display material located in a first plane and second display material located in a second, different plane to generate a three-dimensional display. FIGS. 9 and 10 illustrate a fourth embodiment three-dimensional display frame assembly 150 that has display material located in three different planes.

Display frame assembly 150 includes a display frame 152 like frame 12 that has integral first display material 154 and holds second display material 156 and third display material 158. Each display material 154, 156, 158 is located in its own respective plane.

First display material 154 is similar to display material 14 but does not include a support member. Second display material 156 is like display material 16. Third display material 158 is between the first and second display materials. As shown in FIG. 10, the third display material 158 is preferably sized to cover the void in the first display material created by opening the easel and support tab.

Display material 158 is formed from sheet stock and includes a standoff member 160 die-cut in the stock. See FIG. 11. In use the standoff member 160 is folded at fold line 162 and then reverse-folded at fold line 164 to form elongate standoff sub-members 166, 168 (see also FIG. 9). Standoff 166 extends from the third display material to the first display material and spaces the two display materials apart. Standoff 168 extends from the first display material, through the void formed in the third display material (see FIG. 12), to the second display material to space apart the first and second display materials.

Figure 11:
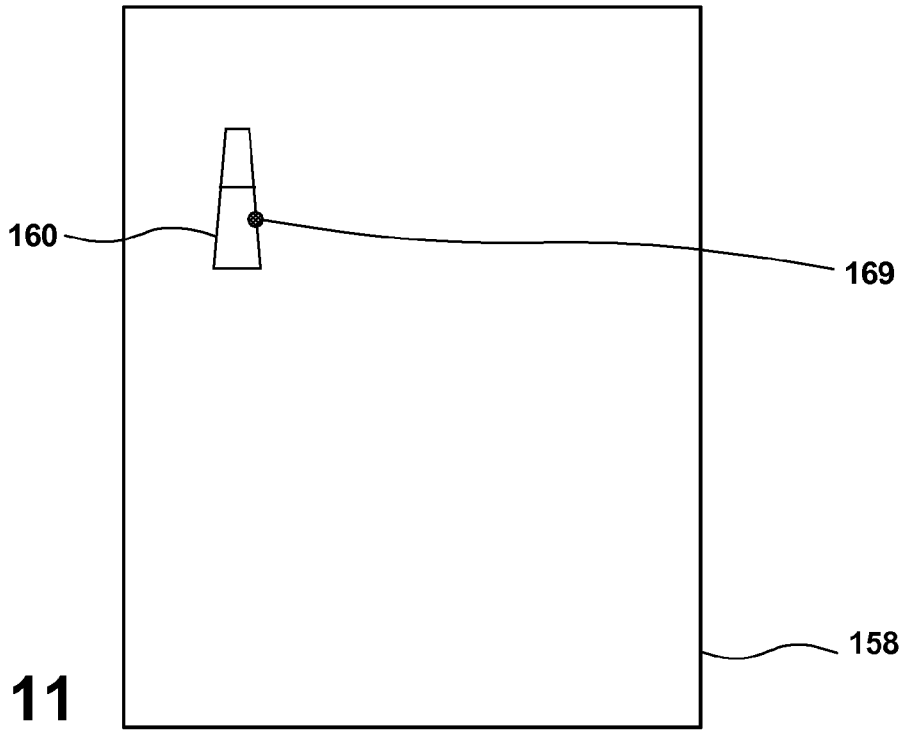
FIG. 11 is a front view of the second display material shown in FIG. 9 prior to the standoff member being unfolded.
Figure 12:
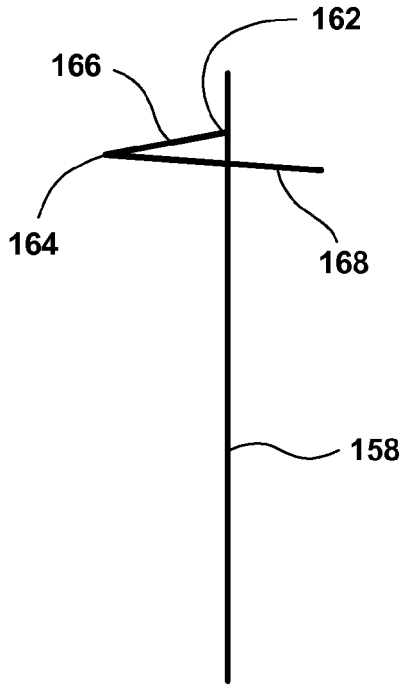
FIG. 12 is a side view of the second display material of the three-dimensional display frame assembly shown in FIG. 11 after folding but prior to being inserted into the display frame.

Standoff member 160 is preferably formed with features that resist the assembly coming apart after assembly. Member 160 is preferably tapered to narrow from one end towards the other as shown in FIG. 11. This creates a tapered void in the display material that narrows towards one end of the void. Movement of the standoff 168 towards the narrow end of the void is resisted by the width of the standoff 168 in the void. The orientation of the taper and standoff member 160 can be selected to resist upward, downward, or sideways motion of the standoff as desired for the particular construction.

Furthermore, standoff 168 is preferably formed with a notch that resists axial movement of the standoff after assembly. The notch is formed by punching a hole 169 (see FIG. 11) in the display material. The hole extends into the side of the standoff 160 and acts to define a reduced-width portion of the standoff. The notch is located such that it engages the side of the display material when the standoff 160 is urged towards the narrow end of the void during assembly.

Figure 13:
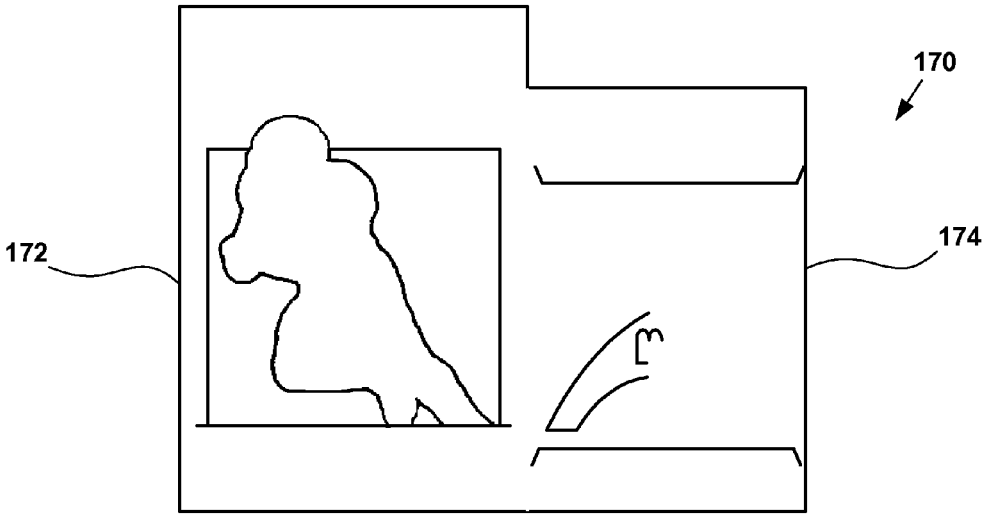
FIG. 13 is a front view of a fifth embodiment three-dimensional display frame assembly that includes an additional single-sheet display frame.
Figure 14:
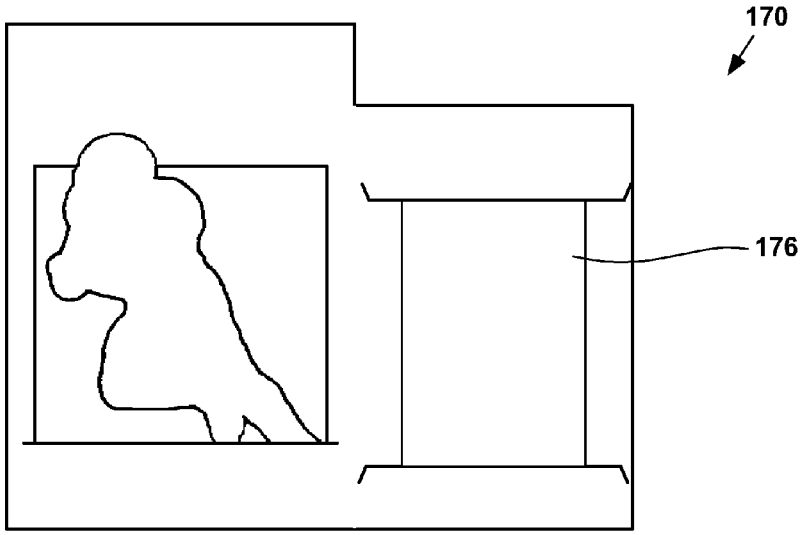
FIG. 14 is a front view of the three-dimensional display frame assembly shown in FIG. 13 with additional display material in the single-sheet display frame.
Figure 15:
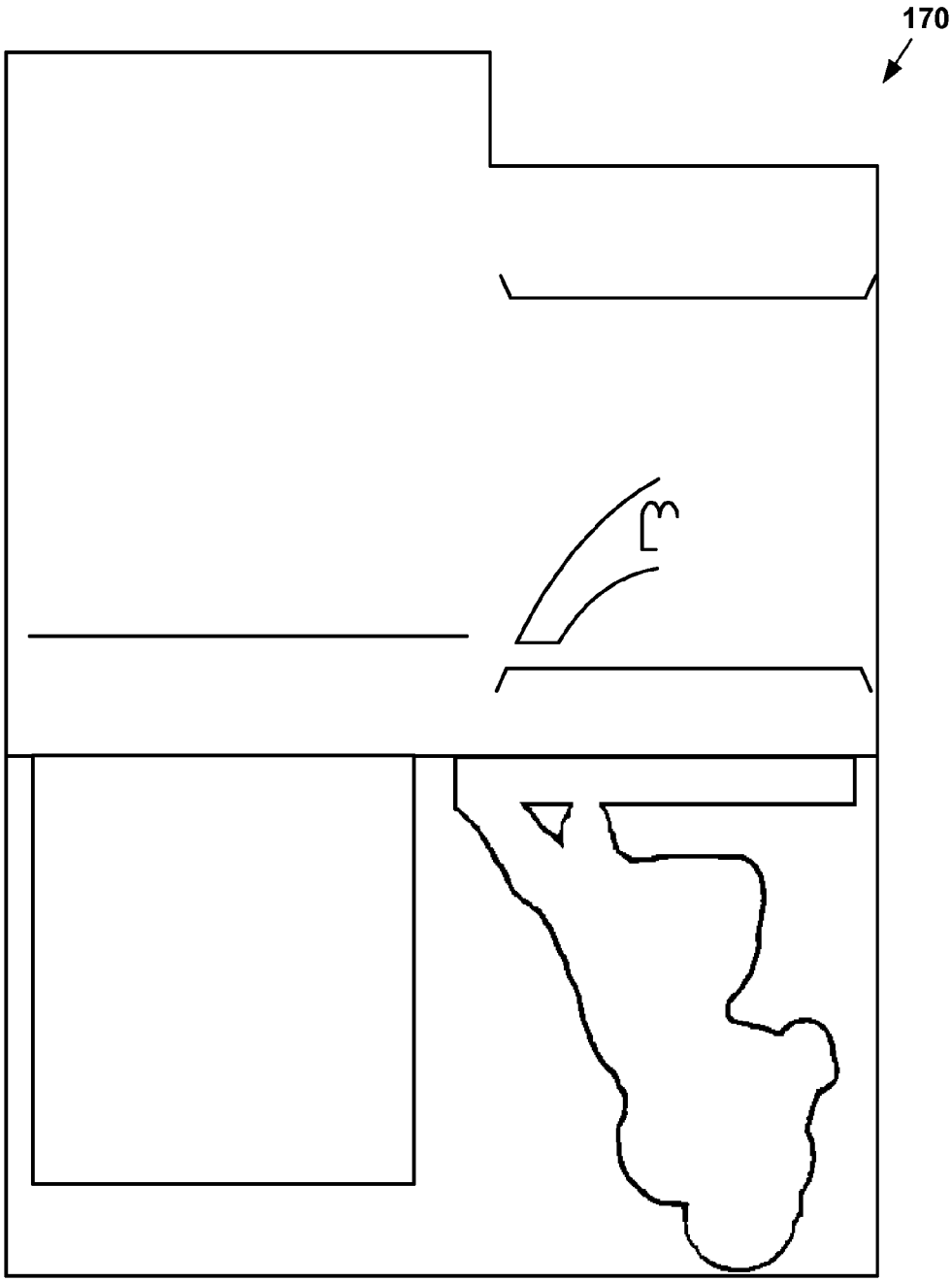
FIG. 15 is a front view of the three-dimensional display frame assembly shown in FIG. 14 being provided as part of a single sheet prior to being assembled to form the three-dimensional display assembly.

FIG. 13 illustrates a fifth embodiment three-dimensional display frame assembly 170. Display frame assembly 170 includes a three-dimensional display frame assembly 172, like three-dimensional display frame assembly 150, and a single-sheet display frame 174 integrally attached to one side of frame assembly 172. The single-sheet display frame 174 enables a user to display his or her own photograph or sports card 176 (see FIG. 14) in addition to the three-dimensional display. As shown in FIG. 15, the components of display frame assembly 170 are distributed unassembled as a flat sheet or preform 178.

Figure 16:
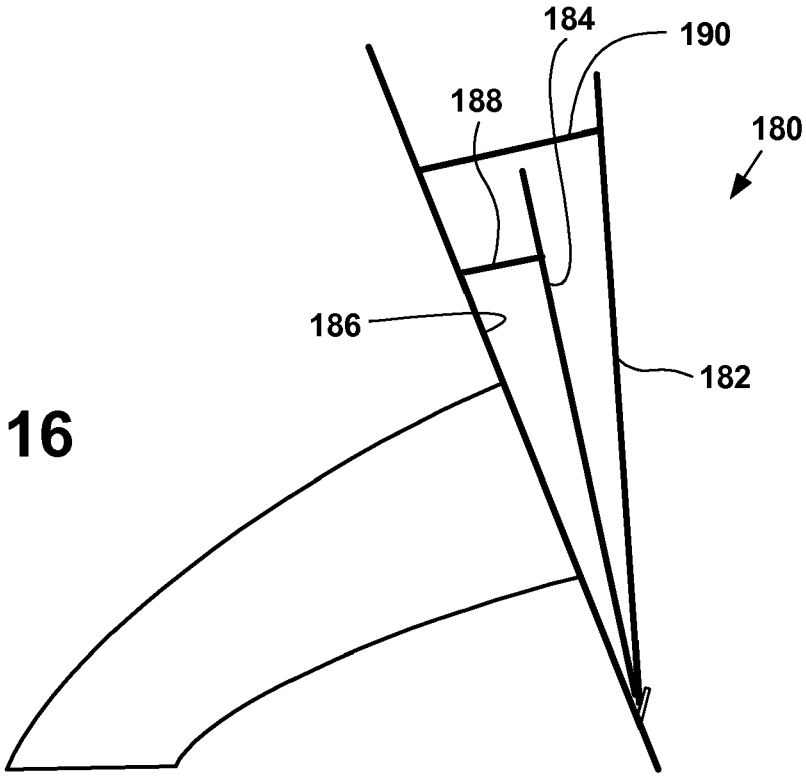
FIG. 16 is a side view of a sixth embodiment three-dimensional display frame assembly.
Figure 17:
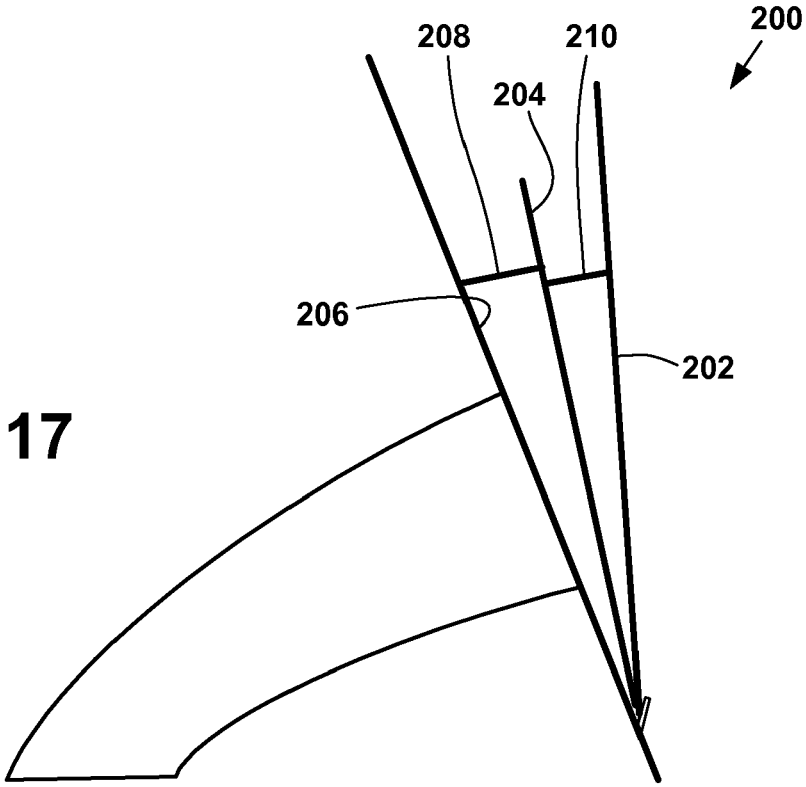
FIG. 17 is a side view of a seventh embodiment three-dimensional display frame assembly.

FIGS. 16 and 17 illustrate other non-limiting examples of spacing the second and third display materials in respective three-dimensional display frame assemblies 180 and 200. Sixth and seventh three-dimensional display frame assemblies 180, 190 are each similar to frame assembly 150. In frame assembly 180, each of the second and third display materials 182, 184 are spaced from the first display material 186 by respective standoff members 188, 190. Standoff members 188, 190 are integrally formed in the frame or in the display material and folded to extend for use.

In frame assembly 200, each of the second and third display materials 202, 204 are spaced from the first display material 206 by respective standoff members 208, 210. Standoff member 208 extends between first display material 206 and third display material 202, and standoff member 210 extends between second display material 202 and third display material 204. Standoff member 208 is integrally formed in the frame, the first display material, or the third display material. Standoff member 210 is integrally formed in the second or third display material.

FIGS. 18-20 illustrate an eighth embodiment three-dimensional display frame assembly 220 that adds a "holographic effect" to the three-dimensional display. Frame assembly 220 includes a display frame 222 like display frame 132, first display material 224, second display material 226, and a standoff member 228 formed in the first display material that spaces apart the first and second display materials. The first display material 224 has a front surface 229 that faces a rear surface 228 of the second display material 226. Surface 229 is formed as a reflective surface, and reflects to the viewer an image 230 of rear surface 228. Surface 229 can be formed by foil-stamping, formed from foil paper, or the like. Foil paper allows for four-color printing or text to be printed on the foil surface.

Preferably rear surface 228 and front surface 232 of the second display material are identically printed so that image 230 as formed is essentially identical to outer surface 230. When viewed from certain viewing angles, a user can see image 230 offset from front surface 232. FIG. 19 illustrates a portion of what a viewer would see, with a portion of image 230 offset from the direct view of front surface 232. The two identical images 230, 232 are offset from one another to provide the holographic effect, or visual sensation of depth. Viewing the display frame assembly at different viewing angles and viewing distances varies the relative offset of the two images for a visually-interesting effect.

In other embodiments front and rear surfaces 228, 232 are printed differently from one another. The difference or contrast of the two offset images 230, 232 can also form a visually-interesting effect.

FIGS. 21 and 22 illustrate a ninth embodiment three-dimensional display frame assembly 240 similar to frame assembly 130. Frame assembly 240 includes frame 242 and removable first display material 244 (the second display material is not shown). The first display material 244 is a card having text or verse so that the display assembly when assembled forms a greeting card, anniversary card, birthday card, holiday card, get-well-card, or the like. The second display material can continue the theme of the text or verse to form a greeting card having unique three-dimensional appeal. For example, an anniversary card could include second or additional display material of the couple's children.

The card 244 may be replaced by another card having different text or verse to effectively form a new greeting card. A photograph or other additional display material can be held in the frame beneath the card. The photograph is revealed when changing cards or is displayed in the frame after the card is discarded.

Figure 23:
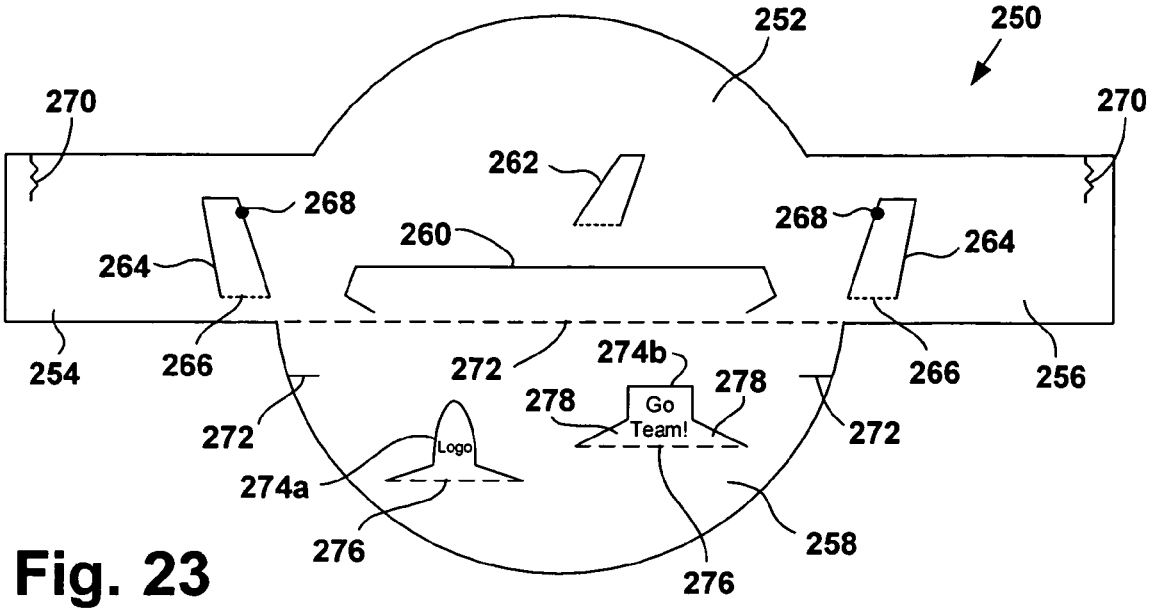
FIG. 23 is a top view of a preform for forming a tenth embodiment three-dimensional display frame assembly that is worn as a hat.

The previous embodiments are intended to form a free-standing display and include an easel for supporting the frame in an upright display position. FIG. 23 illustrates a preform 250 for forming a display frame assembly that can be worn as a hat and so eliminates the easel. The hat is intended to be a party or promotional item to be worn during parties, sporting events, holiday festivities, or for displaying advertisements or promotional messages.

The preform 250 is a flat sheet of flexible paper, cardboard, foam, or the like. The preform includes a frame portion 252, elongate side portions 254, 256 on either side of the frame, and a semi-circular brim portion 258 extending from the bottom of the frame. As shown, frame and brim portions 252, 258 together form a generally circular portion and the side portions are generally rectangularly-shaped.

Die-cut in frame portion 252 is slot 260, like slot 120, and standoff 262, similar to standoff 30. Die-cut in each side portion near the brim portion is elongate tab 264 foldable on fold line 266. A notch is formed in the side of the tab near the brim portion by hole 268. Also die-cut near the free ends of the side portions are slits 270

To form the hat, brim portion 258 is folded upwards along fold line 272 to be perpendicular to the frame portion 252 and form the brim of the hat. Tabs 264 are folded outwardly and engage the brim slots 272 to hold the brim in place. The tab notches engage the brim and help resist movement of the brim/tab assembly. Display material (not shown) is inserted in slot 260 and supported by standoff 262 as previously described to form a wearable three-dimensional display frame assembly.

To wear the hat, the ends of an elastic cord or other hat retaining means are attached to slits 270. Alternatively, holes in the side portions can be provided for attaching the hat to eyeglass frames.

In addition to the three-dimensional display frame assembly, the hat formed from preform 250 includes additional display materials 274*a*, 274*b* that stand up from the brim and add to the three-dimensional display. The additional display materials can be printed with team logos, promotional materials, or any other desired graphics or text and supplement the three-dimensional display frame assembly.

Figure 24:
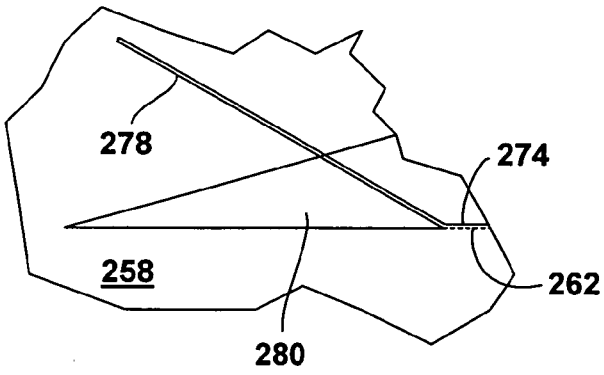
FIG. 24 is a partial top view of a pop-up display of the hat formed from the preform shown in FIG. 23.

Each additional display material 274 is die-cut in brim portion 252 and is foldable along a fold line 276 to stand up away from the brim. To be self-supporting, each display material 274 is die-cut to include elongate tabs 278 on opposite ends of the fold line. Each tab is foldable away from the remainder of the display material and across the void 280 formed in the brim (see FIG. 24). The tab has sufficient length to span the void and be supported by the brim on the opposite side of the void. Folding the tabs across the void helps hide the tabs from view.

It should be understood that the hat can be provided without the additional display material, and/or without display frame features. The brim portion can also be used alone as a sunscreen or visor. In yet other embodiments the display materials 274 can be formed in other sheet-like structures such as, but not limited to, paper plates, greeting cards, posters, and stationary.

In all embodiments of the three-dimensional display frame assembly, multiple display materials can be located in each display plane. For example, second display material 16 can include one or more additional football players. The multiple players can be sized to partially overlap one another if desired.

While I have illustrated and described preferred embodiments of my invention, it is understood that this is capable of modification, and I therefore do not wish to be limited to the precise details set forth, but desire to avail myself of such changes and alterations as fall within the purview of the following claims.

What I claim as my invention is:

1. A three-dimensional display frame assembly for displaying substantially planar first and second display materials, the assembly comprising:

a frame, first display material, and second display material, the first display material defining a first plane and the second display material defining a second plane different from the first plane;

a slot in the frame, the slot of a predetermined configuration and receiving a portion of the second display material to hold the second display material in the frame, the remainder of the second display material extending away from the slot without being otherwise connected to either the frame or the first display material; and a standoff member extending from one of the first and second display planes to the other of the first and second display planes, the standoff member abutting against the other of the first and second display materials without extending through such other of the first and second display materials and without being otherwise connected to the such other of the first and second display materials;

the standoff member spacing apart the first and second display materials wherein the first display material is positioned in the first plane and the second display material is positioned in the second plane to form a three-dimensional display in the frame.

2. The display frame assembly of claim 1 wherein the first display material is an integral portion of the frame and the standoff member extends from the first display material and abuts the second display material.

3. The display frame assembly of claim 1 wherein the standoff member is folded at a fold line on the one of the first and second display materials to extend to the other of the first and second display materials.

4. The display frame assembly of claim 1 wherein the standoff member is foldably attached to one of the following:

the frame, the first display material, and the second display material.

5. The display frame assembly of claim 1 wherein the first display material is an integral portion of the frame and the standoff member extends from the second display material and abuts the first display material.

6. The display frame assembly of claim 1 wherein the slot receives a portion of the first display material and the remainder of the first display material extends away from the slot without being connected to either the frame or the second display material.

7. The display frame assembly of claim 1 wherein the standoff member represents a first standoff member and the display frame assembly comprises a second standoff member and a third display material, the third display material substantially coplanar with the frame; and the second standoff member extends from one of the second and third display materials to the other of the second and third materials, the second standoff member abutting against the other of the second and third display materials and spacing apart the second and third display materials wherein the third display material is positioned in a third plane different from the first and second planes.

8. The display frame assembly of claim 7 wherein the second display material is between the first and third display materials;

the first standoff member extends from a first fold line on the second display material towards the first display material and the second standoff member extends from a second fold line on the second display material towards the third display material.

9. The display frame assembly of claim 1 wherein the first and second display materials each comprise a respective surface, the surfaces facing each other;

the surface of the first display material comprising a reflective surface to reflect an image of at least a portion of the surface of the second display material.

10. The display frame assembly of claim 9 wherein the surface of the second display material represents a first surface and the second display material comprises an opposite second surface facing away from the frame; and the first and second surfaces comprise substantially identical printing whereby a viewer can observe two substantially identical images, one image on the second surface and the other image the reflected image of the first surface.

11. The display frame assembly of claim 7 wherein the second display material is between the first and third display materials; and the first standoff member extends from one of the first and third display materials, past the second display material, and to the other of the first and third display materials to space the first display material from the third display material.

12. The display frame assembly of claim 7 wherein the second display material is between the first and third display materials;

the first and second standoff members are formed from a common member, the common member extending from a first fold line on the second display material to a second fold line abutting the third display material to define the second standoff member and extending from the second fold line to the third display material to define the first standoff member.

13. A three-dimensional display frame assembly for displaying substantially planar at least first, second, and third display materials, the assembly comprising:

a frame, first display material, second display material, and third display material;

a slot in the frame, the slot of a predetermined configuration and receiving a portion of each of the second and third display materials to hold the second and third display materials in the frame, the remaining portions of the second and third display materials extending away from the slot and not being otherwise attached to neither the frame or the first display material; and means for spacing the first, second, and third display materials in respective planes against standoff members without forming additional slots in the frame or the display materials to receive the display materials whereby the display materials form a three-dimensional display in the frame.

14. The display frame assembly of claim 13 wherein the third display material is between the first and second display materials and the means for spacing comprises a support member foldably attached to the third display material, the support member comprising a reverse fold defining a first of said standoff members and a second of said standoff members.

15. The display frame assembly of claim 13 wherein the standoff members comprise first and second standoff members, each standoff member integrally formed with a respective second and third display material to space the respective display material from the first display material.

16. The display frame assembly of claim 13 wherein the standoff members comprise first and second standoff members, the first standoff member extending between the first and second display materials and the second standoff member extending between the second and third display materials.

17. The display frame assembly of claim 13 wherein at least one of said display materials comprises a reflective surface portion.

* * * * *